US005893799A

United States Patent [19]

Studley, Jr. et al.

[11] Patent Number: 5,893,799

[45] Date of Patent: Apr. 13, 1999

[54] TAKE-DOWN AND CONTROL DEVICE

[75] Inventors: Charles Frederick Studley, Jr., Fort Myers; Eugene Emery Cross, Arcadia, both of Fla.

[73] Assignee: Charles F Studley, Jr., Ft. Myers, Fla.

[21] Appl. No.: 09/083,691

[22] Filed: May 21, 1998

[51] Int. Cl.[6] ..... A63B 59/00

[52] U.S. Cl. ..... 463/47.2; 294/19.1; 119/807

[58] Field of Search ..... 463/47.2, 47.4, 463/47.7; 294/9, 10, 11, 15, 19.1, 19.3, 22, 23, 34; 119/801, 806, 807, 808

[56] References Cited

U.S. PATENT DOCUMENTS

| | | |
|---|---|---|
| 284,165 | 4/1883 | Bean . |
| 327,575 | 10/1885 | Mitchell . |
| 832,143 | 10/1906 | Mercer . |
| 1,586,412 | 3/1926 | Curtis . |
| 2,522,454 | 9/1950 | Lewry . |
| 3,347,586 | 10/1967 | Sharp . |
| 3,743,339 | 7/1973 | Brackett . |

*Primary Examiner*—William M. Pierce
*Attorney, Agent, or Firm*—Charles F. Studley, Jr.; Emory E. Cross

[57] ABSTRACT

The invention is directed to a take-down and control device intended to be used by police officers when violent subjects need to be controlled before being arrested. The device consists of an elongated rod which slides in a tube. The rod at one of its ends has a hook that can be hooked around a subject's leg while the tube on its end that is close to the hook on the rod has an upstanding and curved plate having a general plane which is 90° offset from the plane of the hook. After the hook is hooked around a subject's leg, the tube will be slid down on the rod until the curved plate engages the subject's leg at a point on the leg which is opposite of the point on the leg where the hook has been engaged. A ratchet mechanism on the tube keeps the tube and rod in a locked position. A T-handle on the other end of the rod allows the officer to twist the device in various directions until the subject loses his balance and is thereby taken down and can be controlled. The device is of a sufficient length to always keep the officer at a safe distance from the subject.

3 Claims, 4 Drawing Sheets

TAKE-DOWN AND CONTROL DEVICE

BACKGROUND OF THE INVENTION

This invention pertains to a device that is particularly useful for policemen while performing their duties. Their duties include the apprehension of criminals and persons exhibiting antisocial behavior. The majority of individuals that are being arrested are under the influence of alcohol or drugs or both. If the individual is under the influence of crack or PCP, the only way to subdue that person is to use a choke hold (arm bar) to occlude both carotid arteries. This deprives the brain of oxygen and induces unconsciousness. Although most law enforcement agencies have forbidden the use of this method, an individual officer, faced with his own survival, probably will use it.

The officer's liability exposure is only a secondary consideration when personal safety is at risk. It is a known fact that individuals that are under the influence of alcohol or drugs and when faced with imminent arrest tend to become very violent and will resist arrest. Even some individuals that are not under the influence of any substances may become violent when being arrested because of their explosive temperament.

Therefore, the police officer in any of the above noted circumstances always faces great personal harm to himself because of being in close proximity to the individual facing arrest.

Many methods are being used to aid the officer in subduing the above noted individuals such as using maze, pepper spray or tazers including the officer's own night stick. However, all of the above noted methods still place the officer in close proximity of the individuals about to be arrested. Additionally, the officer, as well as the department under which auspices the officer operate, is faced with liabilities when personal harm befalls the individual about to be arrested which has been documented many times. If the officer can operate from a safe distance, his own confidence is strengthened.

OBJECTS OF THE INVENTION

The take-down and control device is a tool that minimizes the risk of harm to the officer when restraining a subject during a police operation while maximizing the control of the subject.

The tool also minimizes the officer's potential risk of harm or injury to the individual about to be arrested which substantially reduces the officer's or the department's chances of liabilities. The device, in most situations, will provide a quick and effective resolve without the use of any of the above mentioned restraining methods. In all instances, the officer maintains a safe distance from the subject while effectively subduing the same without inducing any harm or injury.

BACKGROUND OF THE INVENTION

There are known devices or mechanical tools that address the above noted problems to keep a safe distance between the officer and the subject about to be subdued.

U.S. Pat. No. 284,165 shows a policemen's hook consisting of two parts with a spring biased to always keep the hook open so the officer has to use his hand to close the hook around a subject's wrist. The officer is still in close proximity to the subject.

U.S. Pat. No. 327,575 is directed to policeman's nippers that again are intentioned to be applied to a subject's wrist.

It does include a ratchet mechanism that will incrementally close and hold around a subject's wrist. The officer is still in close proximity to a subject about to be arrested.

The U.S. Pat. No. 832,143 to Mercer illustrates a "policeman's nipper" consisting of a stationary jaw and a movable jaw moving within the stationary jaw. Included is a ratchet that will keep the two jaws in an adjusted position. This device is similar to what the applicant will disclose in the subsequent specification but is different as will be explained below.

This tool is designed to be applied to a subject's arm whereby the officer will remain in close proximity to the subject about to be arrested.

U.S. Pat. No. 1,586,412 to Curtis discloses a policeman's baton or night stick which includes a clamping arm to be applied to the wrist of a subject. The officer is still in close proximity to a potential subject.

All of the above mentioned tools or devices and when applied to a subject's wrist or arm have one common deficiency and that is that the control arms are very narrow and can rotate around the subject's wrist or arm relative to a plane of the subject's arm or wrist to a point where the subject's limb can be injured or even broken. It also allows the subject's distance to the officer to be changed to expose the officer to possible harm.

The invention at hand will alleviate many of the above noted problems as will be explained below.

DETAILED DESCRIPTION OF THE DRAWINGS

Figure 1:
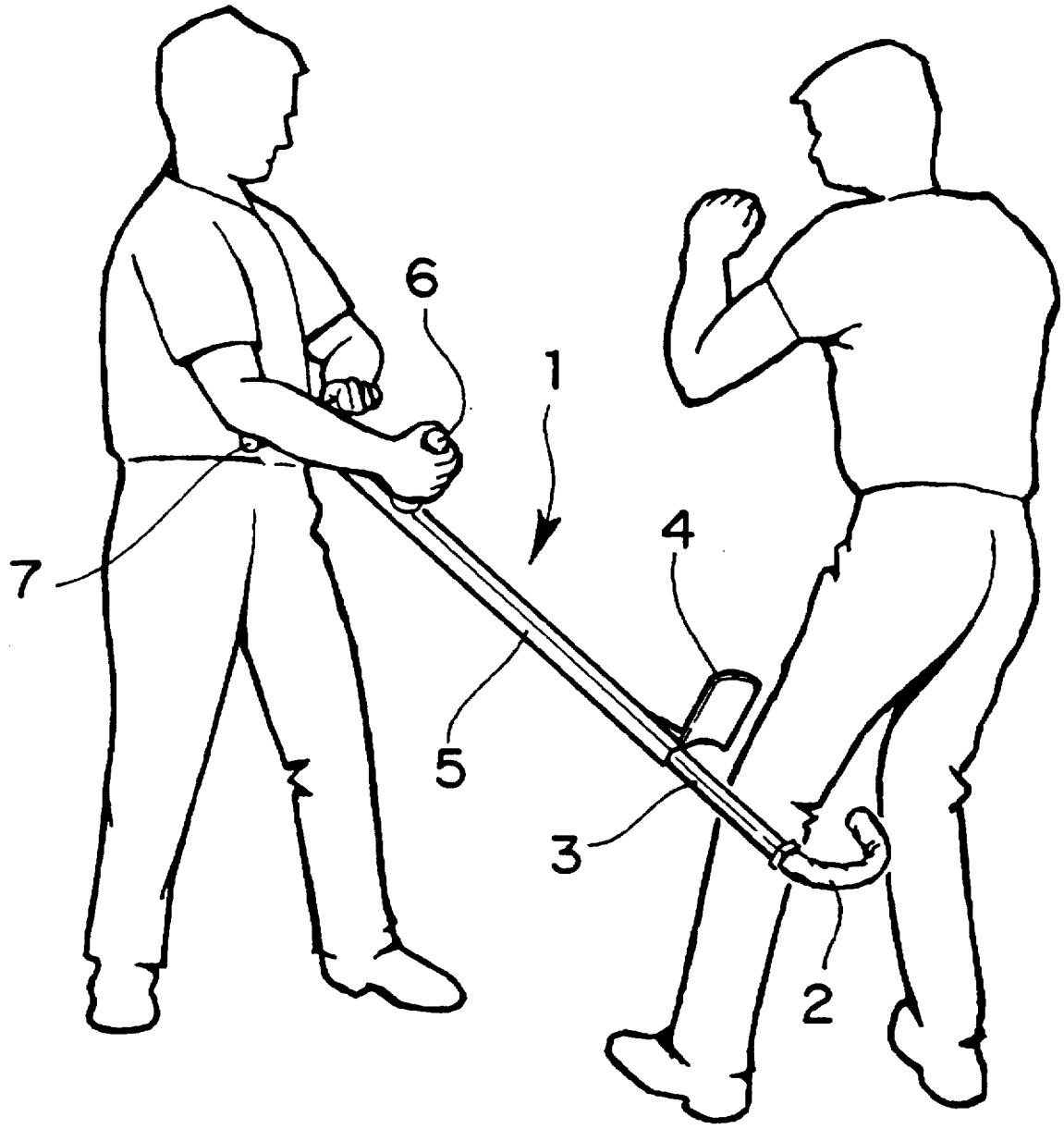
FIG. 1 shows the device of the invention about to be closed on a subject's leg.

FIG. 1 shows the device 1 of the invention about to be closed on a leg of a subject to be arrested. The device itself consists of a hollow tube 5, preferably of a square configuration within which a correspondingly shaped rod 3 will slide back and forth.

Figure 2:
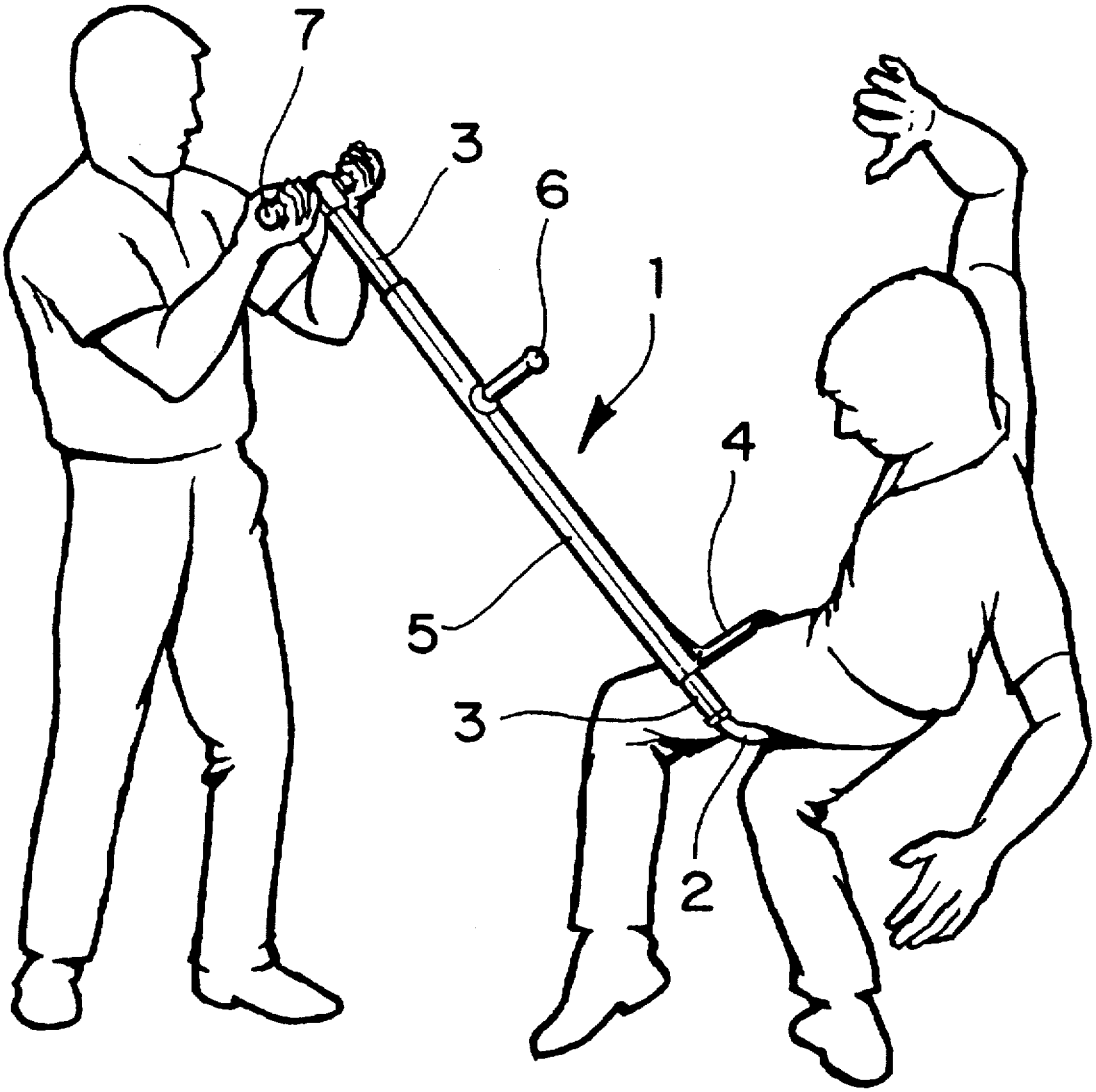
FIG. 2 shows the device of the invention after it has been closed on a subject's leg.

At the lower end of rod 3 a U-shaped hook 2 is either attached or shaped from the same material as rod 3. Attached to the lower end of tube 5 is a pad or plate 4 which in its plane is 90° offset from the hook 2 and is also curved within the offset plane. As can be seen from FIG. 1, the curvature of the leg of the subject about to be arrested follows the curvature of the pad or plate 4. This is especially designed so that the leg of the subject after it has been captured cannot rotate toward the officer, see FIG. 2. Also the officer has more leverage on the device in order to take down and control the subject. Also in FIGS. 1 and 2 there is shown a handle 6 mounted on the tube 5 but it is 90° offset from the plane of hook 2 but parallel to the plane of plate 4 on the tube 5. At the upper end of interior rod 3 there is a further handle 7 which forms a T with interior rod 3. The T-shaped handle 7 on the interior rod 3 gives the officer a two handed grip on the device once it is closed on the leg of the subject. The handle 6 which is 90° offset from the plate 4 or the T-shaped handle 7 gives the officer a chance to exert a force toward the leg of the subject or in the same direction as plate 4.

Figures 3A, 3B:
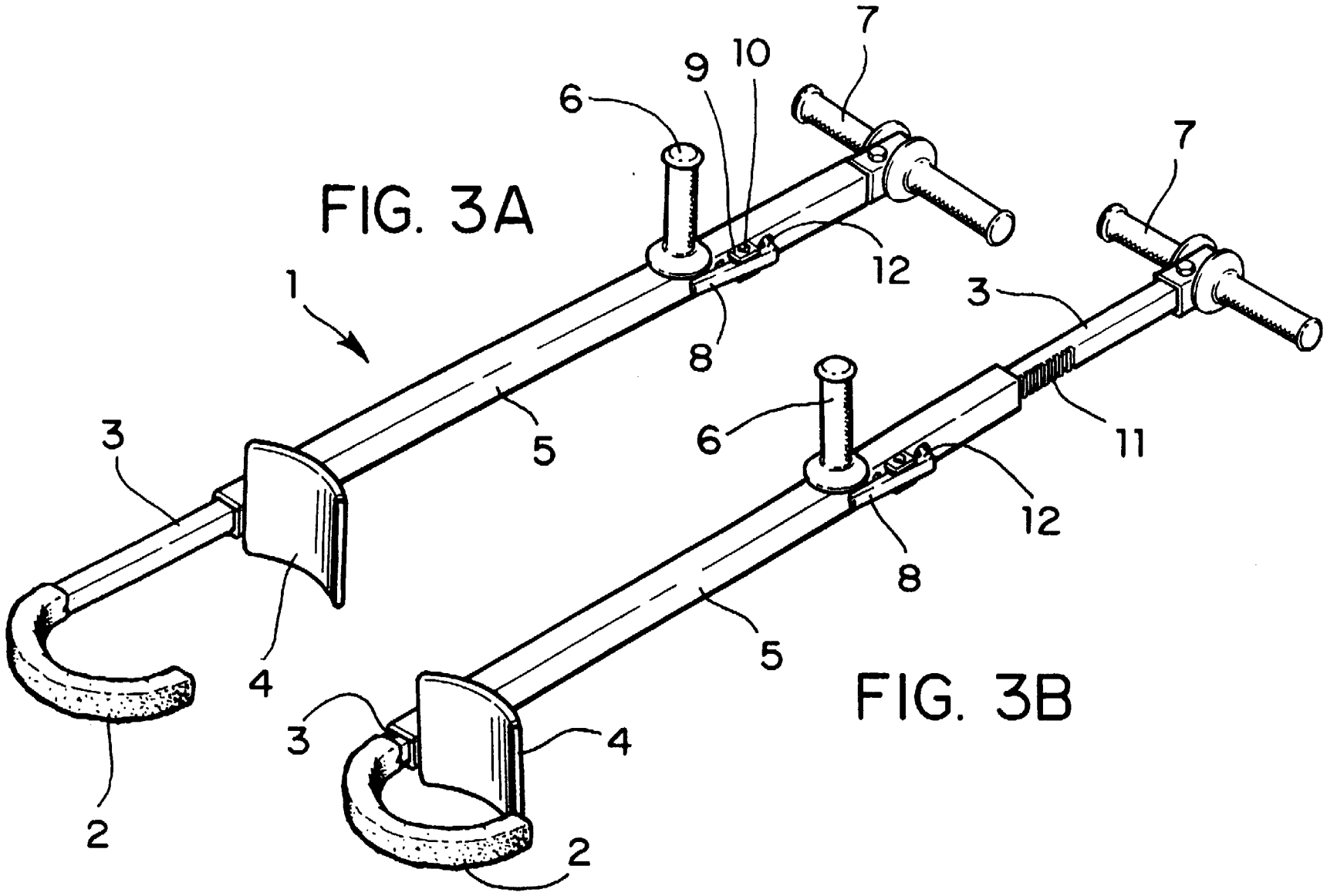
FIG. 3A shows details of the inventive device in an open position.
FIG. 3B shows details of the inventive device in a closed position.

FIGS. 3A and 3B show the device of the invention in open or closed position, respectively. These Figures also show the ratchet mechanism closely associated with the handle 6. The ratchet mechanism consists of a single pawl 8 which is pivoted at 9 to two flanges 10 mounted on the tube 5.

Figure 4:
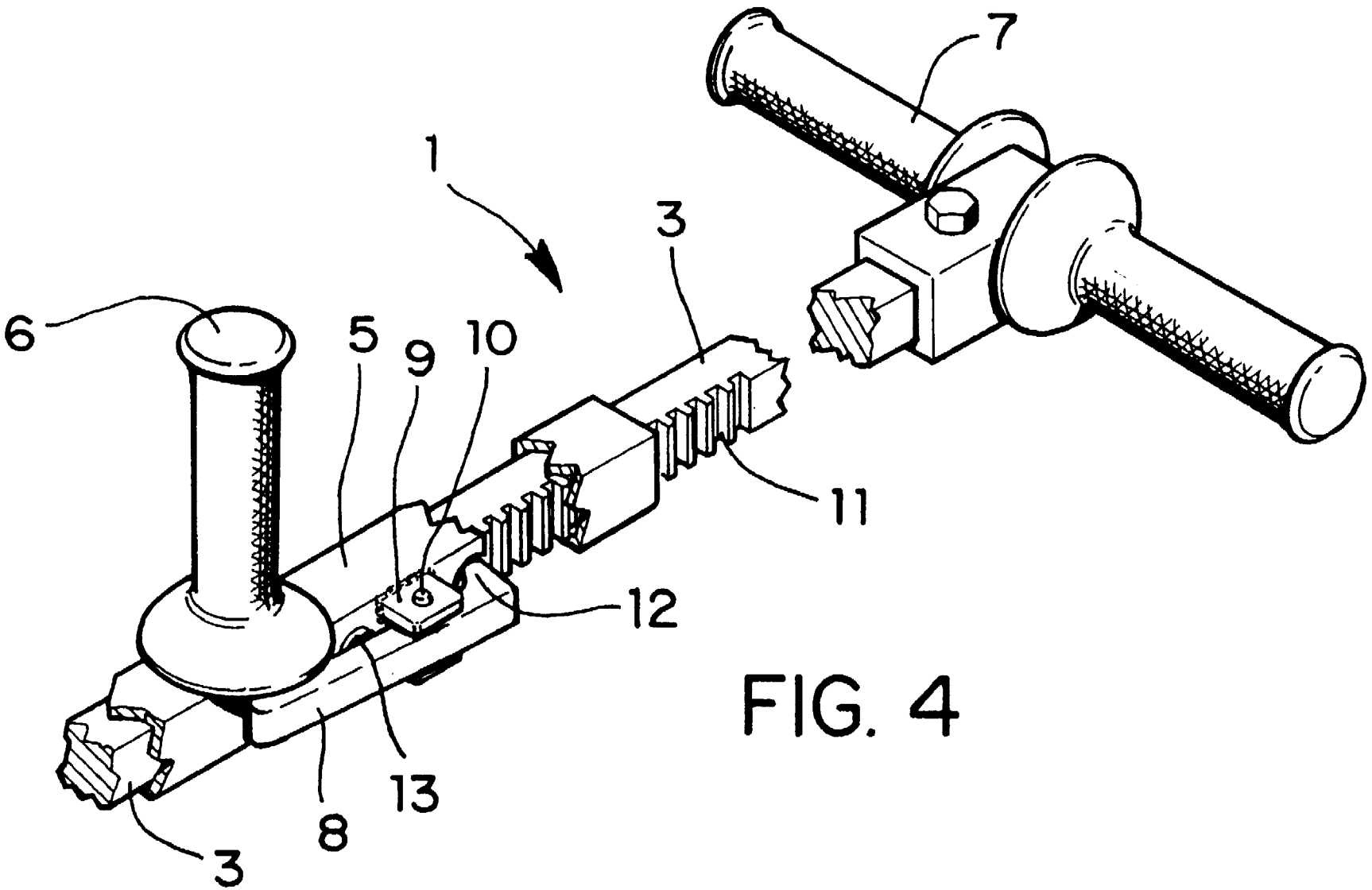
FIG. 4 shows details of the relationship between the interior rod and the exterior tube and the details of the ratchet mechanism.

Turning now to FIG. 4, there is shown the detail of the ratchet mechanism. To this end, there is shown the pawl 8 having a hook nose 12 which is shaped in such a manner that it operates in one way only. That is, it is locked in one way but may slide in the other direction.

In different words, the pawl will allow the exterior tube 5 to slide toward the leg of the subject until contact is made with the leg but the pawl 8 will not allow a return movement until the pawl 8 is released. The pawl is always biased toward the ratchet teeth 11 by a compression spring 13 at the end which is opposite the end of the pawl 8 from its hook portion 12.

The pawl 8 is also placed on the tube 5 so that it is within easy finger reach of a hand that is gripping the handle 6.

SUMMARY OF THE INVENTION

The take-down device of the invention is about 46" long. It has long been established that a change in size of a known device "Mercer" does not convey patentability to a later claimed device.

However, it has been found that the device of this invention clearly has an advantage over the "Mercer" reference in that it is intended to be applied to a leg of a subject, while "Mercer's device clearly is intended to be applied to the arm of a subject. As a matter of fact the device of the invention could be applied to both the leg and the arm of a subject whereby the officer will always be at a safe distance from the subject.

Another significant feature of the invention at hand is the presence of the curved plate or pad 4 and the way it is attached to the tube 5. It is attached to the end of the tube 5 and it has a plane which is 90° offset from the plane of the hook 2.

In this manner, when a subject is about to be subdued, the hook 2 is placed around the leg of a subject while at the time the tube 5 by way of handle 6 is slid toward the subject until the pad 4 makes contact with the leg of a subject at point which is opposite the point of contact of hook 2. At the same time the hook nose 12 of ratchet 8 will make contact with one of the ratchet teeth 11 on the rod 3 to thereby lock the same into place. As can be seen from FIG. 2, this locked engagement will enable the officer to have complete control over the subject and will enable the officer to safely bring the subject to the ground. The plate 4 will not allow the subject to lunge toward The officer. The placement of the single ratchet pawl 8 on the tube 5 also is important because this will allow for a single finger operation by the officer who may have his hand on the handle 6. The use of a single pawl 8 which is in direct contact with the ratchet teeth 11 simplifies the ratchet mechanism considerably which contributes to a low cost construction.

In view of all of the above it now becomes clear that the device enables the officer to have total control over the subject without subjecting the same to any injuries. The officer maintains total control because the way the various elements have been placed on the device including the upstanding plate 4. The feeling of having total control has a calming effect on the situation at hand including the suspect who realizes the fact that any further resistant is fruitless. Such total control has not been found in the prior art devices because the way they are constructed.

What we claim is:

1. A take-down and control device for use by an officer to take down and control a subject about to be arrested comprising a shaped tube having a complimentarily shaped rod sliding therein, said tube having at one end thereof an upstanding and curved plate having a general plane and further having an upstanding handle placed proximal the other end of said tube which extends in the same direction as the general plane of said plate, said rod sliding within said tube having a rigid hook at an end which is adjacent to the end of said tube having said plate thereon, a plane of said hook being offset by 90° from the general plane of said plate, a ratchet mechanism on said tube allowing said rod to move in one direction but preventing the rod from movement in the other direction relative to said tube.

2. The take-down and control device of claim 1, wherein said ratchet mechanism includes a single pawl having a hook nose at one end and means for biasing said hook nose into engagement with ratchet teeth on said rod through an aperture in said tube.

3. The take-down and control device of claim 1, wherein said ratchet mechanism on said tube is located within finger reach of said handle on said tube.

* * * * *